US006516625B2

(12) United States Patent
Bedard

(10) Patent No.: US 6,516,625 B2
(45) Date of Patent: Feb. 11, 2003

(54) JUICE DISPENSING APPARATUS

(76) Inventor: Mark Bedard, 675 Anyon, Greenfield Park, Quebec (CA), J4V 2G1

( * ) Notice: Subject to any disclaimer, the term of this patent is extended or adjusted under 35 U.S.C. 154(b) by 0 days.

(21) Appl. No.: 09/955,412

(22) Filed: Sep. 18, 2001

(65) Prior Publication Data

US 2002/0043070 A1 Apr. 18, 2002

Related U.S. Application Data

(63) Continuation-in-part of application No. 09/688,760, filed on Oct. 13, 2000, now abandoned.

(51) Int. Cl.[7] ..... B67D 5/62
(52) U.S. Cl. ..... 62/389; 62/392
(58) Field of Search ..... 62/389, 392, 3.64; 222/146.6

(56) References Cited

U.S. PATENT DOCUMENTS 3,934,758 A * 1/1976 Kipp ..... 222/108
4,784,297 A * 11/1988 Katz ..... 222/161
5,000,348 A * 3/1991 Emody ..... 222/105
5,156,297 A * 10/1992 Engler ..... 141/83
5,558,006 A * 9/1996 Kuboyama ..... 426/432
5,803,312 A * 9/1998 Credle et al. ..... 222/129.1
6,026,988 A * 2/2000 Teetsel et al. ..... 222/108

FOREIGN PATENT DOCUMENTS

JP 402051905 A * 2/1990 ..... 333/187

* cited by examiner

*Primary Examiner*—William E. Tapoloal
*Assistant Examiner*—Mohammad M. Ali
(74) *Attorney, Agent, or Firm*—Eric Fincham

(57) ABSTRACT

A juice dispensing apparatus particularly designed for dispensing a "not from concentrate juice" packaged in a bag in a box format, the apparatus having a compartment in which the bag in a box is mounted, a thermoelectric device for cooling the compartment and a piezoelectric device for agitating the juice in the bag to thereby maintain the juice in a suspension. The apparatus requires minimal maintenance while permitting the dispensing of fruit juices or vegetable juices which are not reconstituted from a concentrate.

15 Claims, 8 Drawing Sheets

JUICE DISPENSING APPARATUS

This application is a Continuation-in-Part of S.N. 09/688,760 filed Oct. 13, 2000., now abandoned.

FIELD OF THE INVENTION

The present invention relates to a liquid dispenser and more particularly, relates to dispensers suitable for dispensing juices and to a method therefore.

BACKGROUND OF THE INVENTION

The dispensing of liquids from a dispensing apparatus is well known in the art and many different types of dispensers are known and commercially available. The known apparatuses are designed for dispensing soda drinks, certain types of juices, milk, coffee, tea, hot chocolate, etc. These machines may either be designed to be used by a staff in a hospitality outlet such as a restaurant or alternatively, directly for use by the consumer. Some of these machines have a mechanism for receiving money and dispensing a predetermined amount of liquid.

In the field of dispensing juices, certain problems are encountered. A juice typically is a suspension containing solids and thus, means must be provided to keep the solids in suspension before dispensing. One such a type of machine places the juice in a container (typically formed of a plastic or glass material) in which the juice is continually pumped and refrigerated. A drawback with this type of system is that the juice is continually exposed to oxygen and thus the quality of the juice will deteriorate quickly. Secondly, such a machine requires frequent cleaning and is a high maintenance system.

In order to overcome these disadvantages, the industry has developed various types of apparatuses for dispensing reconstituted citrus fruit or vegetable juice concentrates. A portion of concentrate is first dispensed, then mixed with water and is subsequently dispensed into a cup or other receptacle. Problems which are encountered include the dispensing of the juice concentrate, which carries pulp and other solids, with an efficient flow through valves and the like. Generally, such systems have multiple valves which operate to mix independent flows of water and juice concentrate to control the brix of the final product which is then dispensed into a cup or glass. The dispensing apparatus usually includes a cooling system which uses refrigerant filled coils to form an ice bank which is surrounded with conduit coils through which the water passes and is chilled. It is generally not necessary to cool the concentrate because of the ratio of water to concentrate and the fact that water is independently cooled.

Many people do not enjoy the taste of a juice made from a concentrate which is subsequently mixed with water. Indeed, many juices available for home consumption are packaged in containers and they are specifically labeled that they are not from a concentrate. Even though the concentrate provides a far more efficient means of shipping, the not from concentrate (NFC) market is a substantial one and one which is not well served by the currently available dispensing apparatuses.

SUMMARY OF THE INVENTION

It is an object of the present invention to provide a dispensing apparatus suitable for dispensing a fluid from a container wherein the fluid requires agitation.

It is an object of the present invention to provide a dispensing apparatus suitable for dispensing a juice which is not from a concentrate.

It is a further object of the present invention to provide a method for marketing not from concentrate juices in the hospitality industry.

According to one aspect of the present invention, there is provided a fluid dispensing apparatus suitable for dispensing a fluid packaged in a container, the apparatus comprising a housing having a compartment to receive the container, means for cooling the compartment, means for agitating the fluid while in the container in the compartment, and means for controlling the flow of the fluid from the container.

In a further aspect of the present invention there is provided, in combination, a juice dispensing apparatus and a juice container, the juice container comprising a bag in a box containing a juice in the bag, the apparatus comprising a housing having a compartment, the juice container being mounted in the compartment, means for cooling the compartment, means for agitating the juice in the juice container, and means for controlling the flow of the juice from the bag.

In a still further aspect of the present invention there is provided a method for dispensing a juice comprising the steps of packaging the juice in a bag in a box container, placing the container in a compartment of a juice dispensing apparatus, cooling the compartment, maintaining the bag in contact with agitating means, agitating the bag to maintain the juice in a mixed condition, and discharging the juice from a spigot formed in the bag In greater detail, the fluid dispensing apparatus of the present invention may be used to dispense a variety of different products. Thus, the dispensing apparatus of the present invention is ideally suited for the dispensing of juices not made from a concentrate as it addresses a long standing problem. These juices may include fruit juices and/or vegetable juices. However, it will be understood that the dispensing apparatus may be used to dispense any suitable fluid. Therefore, when reference is made to dispensing juice, it will be understood that the term includes any fluid which could be operably dispensed.

The dispensing apparatus of the present invention is preferably used with a container of fluid packaged in a bag in a box format. Such formats are well known in the art and widely used for transporting liquids. The bag is formed of a suitable plastic material and in a preferred embodiment, comprises an EVOH material. The box is typically formed of a corrugated paperboard material. It will, however, be understood that other suitable containers may be employed in the practice of the present invention.

As aforementioned, the apparatus includes a compartment formed within the apparatus and which compartment includes means for maintaining the same in a chilled or cooled condition. In this respect, any suitable cooling means may be utilized although in a preferred embodiment, a thermoelectric device is utilized. Since, in the preferred embodiments, the juice is shipped in a chilled condition, the thermoelectric device provides enough capacity to maintain the compartment at the desired temperature. Preferably, the thermoelectric device is arranged such that it is mounted adjacent one of the walls of the compartment with a heat sink operatively connected to a cold side of the thermoelectric device being mounted in the compartment. There are also preferably provided means for circulating the air in the compartment–i.e. suitable blower or fan means.

On the other side, the thermoelectric device will include a heat sink connected to the warmer side of the device. This warm heat sink is preferably well insulated from the compartment and means are provided for circulating air over the warm heat sink to remove the heat and convey it exteriorly of the apparatus.

As aforementioned, there must be provided means for maintaining the juice or other fluid in a mixed state wherein any solids are maintained in suspension and the liquid is relatively homogeneous. Although various mechanical means and/or other means such as ultrasonics could be utilized, a preferred means comprises the use of piezoelectric properties of a material. Thus, one can provide intermittent pulses of current to a material having piezoelectric properties and cause a vibration of the material.

In a preferred embodiment, piezoelectric ceramics are utilized to agitate the liquid in the bag. Conveniently, a plurality of piezoelectric ceramics may be bonded to a suitable material such as a glass, the device being placed such that the bag of the bag in a box container rests on the device. In a preferred embodiment, the configuration or exterior outline of the portion containing the piezoelectric ceramics would not present square comers, but rather would be oval or have another curved configuration.

Typically, a dispensing outlet for the bag in a box format may include either a spigot or a valve structure and in one embodiment of the present invention, there is provided an outlet tube therefrom. The outlet tube is designed to extend through an opening in the bottom of the compartment to a location where the liquid may be dispensed to a suitable cup or glass or pitcher. The apparatus will also include means for controlling the flow of the liquid from the bag; although there are known metering devices such as shown in U.S. Pat. No. 5,413,252, a simple stop/start arrangement may be provided. To this end, any suitable device to squeeze a tube closed may be utilized. In a preferred embodiment, a valve structure such as is commonly used for boxed liquids such as wine may be used. In such an arrangement, a mechanism for opening the valve may be activated by a solenoid.

In a preferred embodiment of the invention, there is provided a scale placed in the bottom of the compartment. The scale is operative to continually measure the weight of the container. The measurement of the weight can be utilized to control how long the agitating means function and also could be utilized to control a dispensing time such that a constant portion of liquid is dispensed during any dispensing cycle irrespective of the amount of liquid left in the container. Furthermore, the information on the weight can be useful to advise when the container is nearing empty.

The control mechanisms of the dispensing apparatus may be arranged in any different number of manners. One could include circuit boards to monitor and then control the cooling cycle, the dispensing cycle and the agitation cycle. It suffices to say that it is well within the knowledge of those skilled in the art to provide for such controls.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
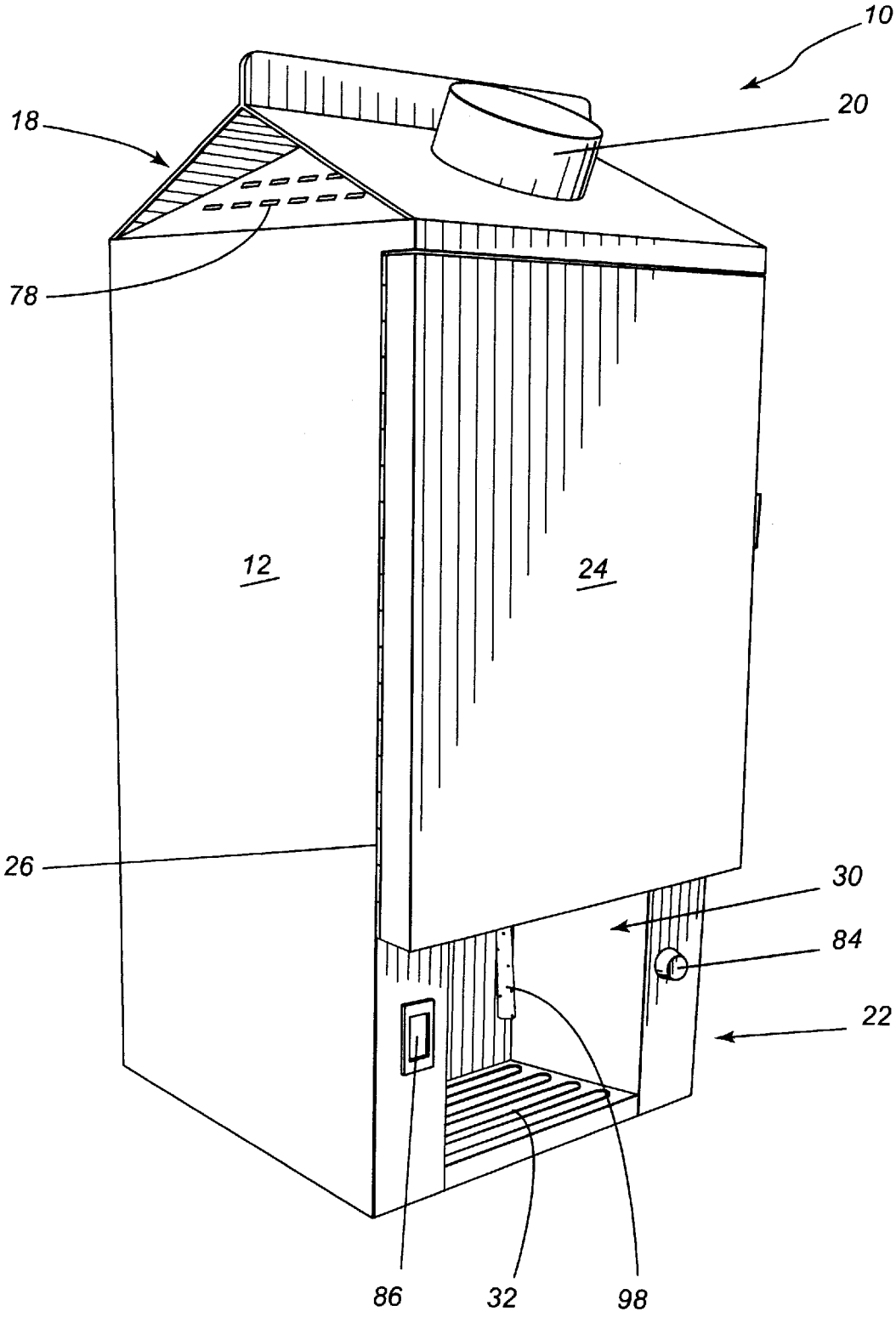
FIG. 1 is a perspective view of a juice dispensing apparatus according to an embodiment of the present invention.
Figure 2:
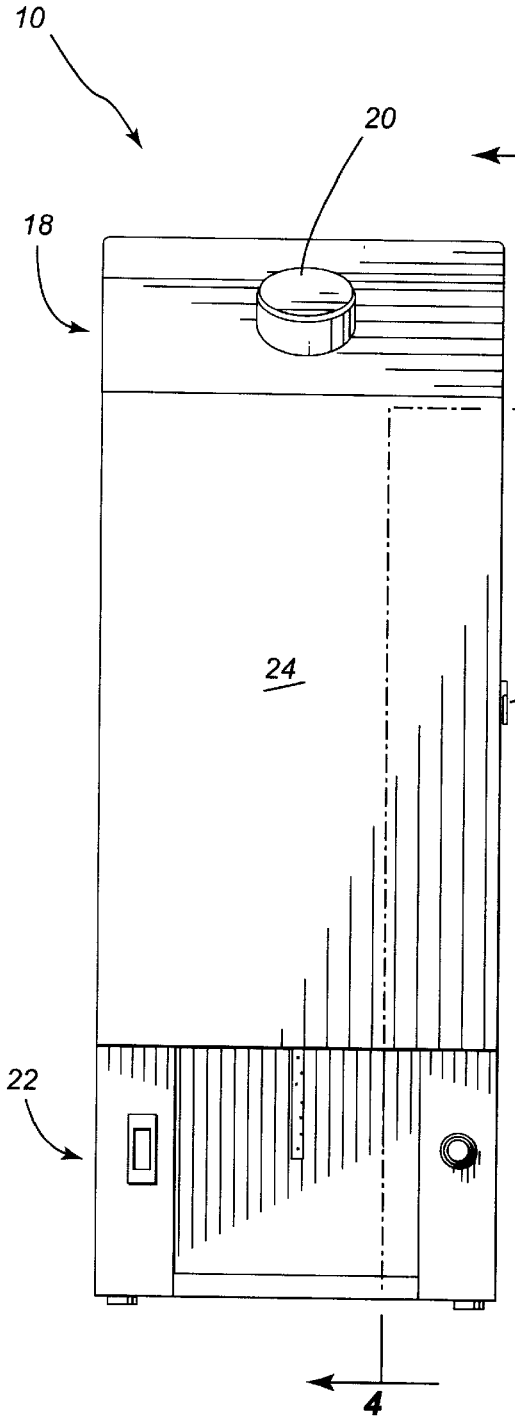
FIG. 2 is a front elevational view thereof.
Figure 3:
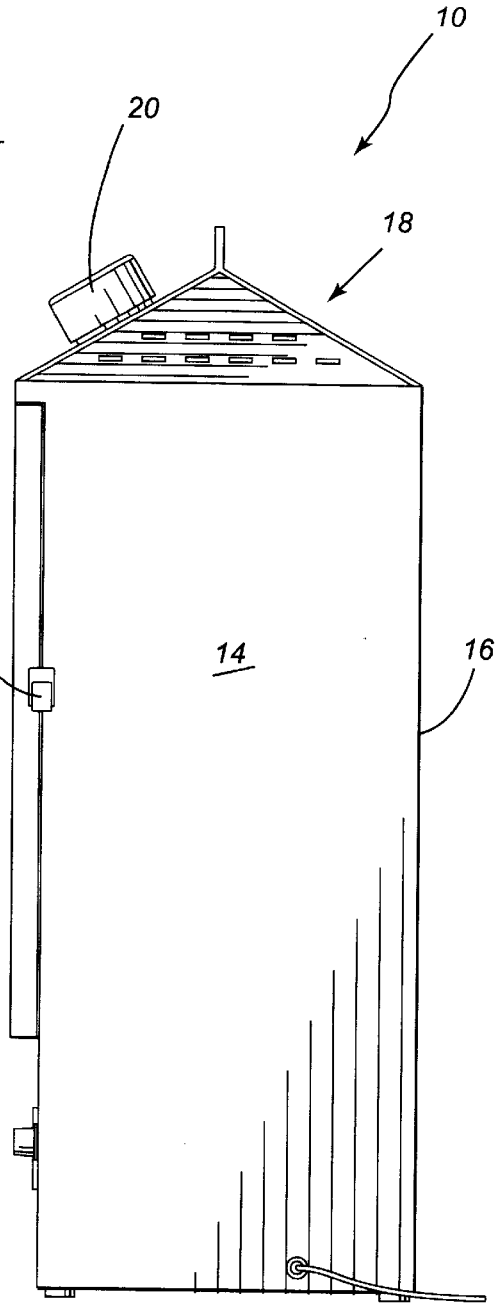
FIG. 3 is a side elevational view thereof as seen from the right hand side of FIG. 1.
Figure 4:
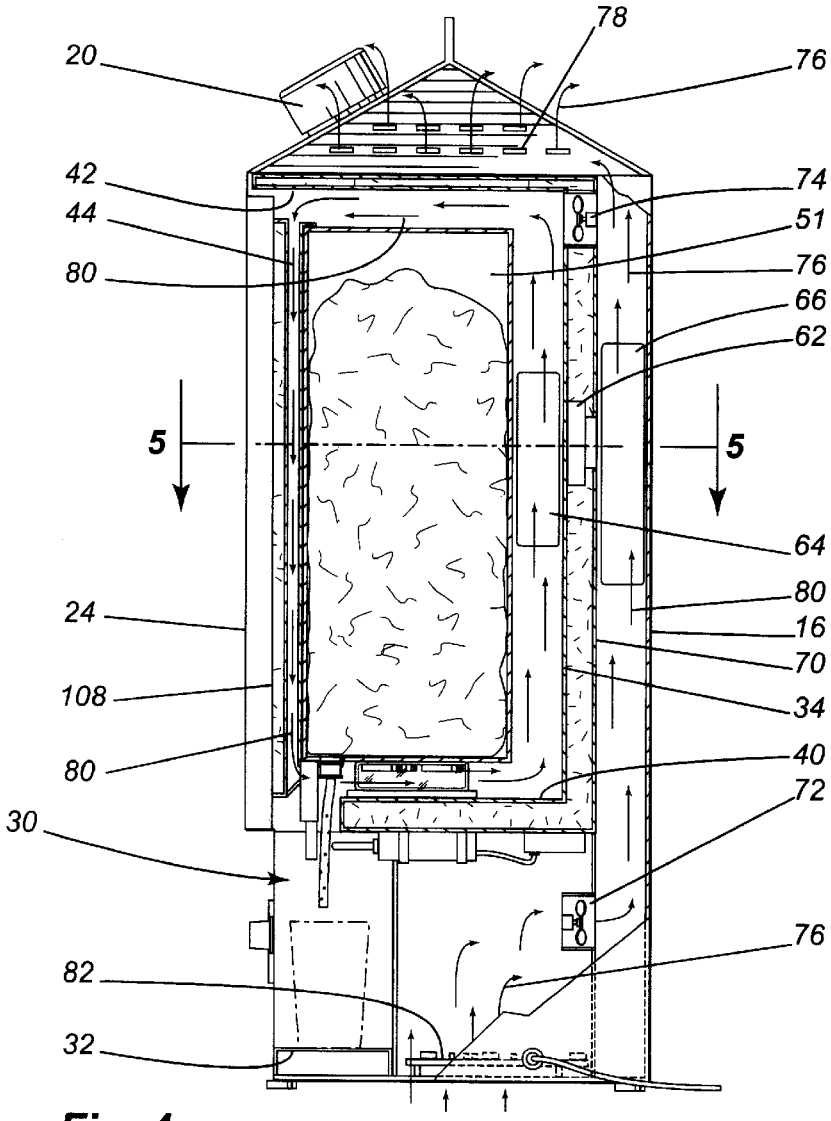
FIG. 4 is a sectional view taken along the lines 4—4 of FIG. 2.
Figure 5:
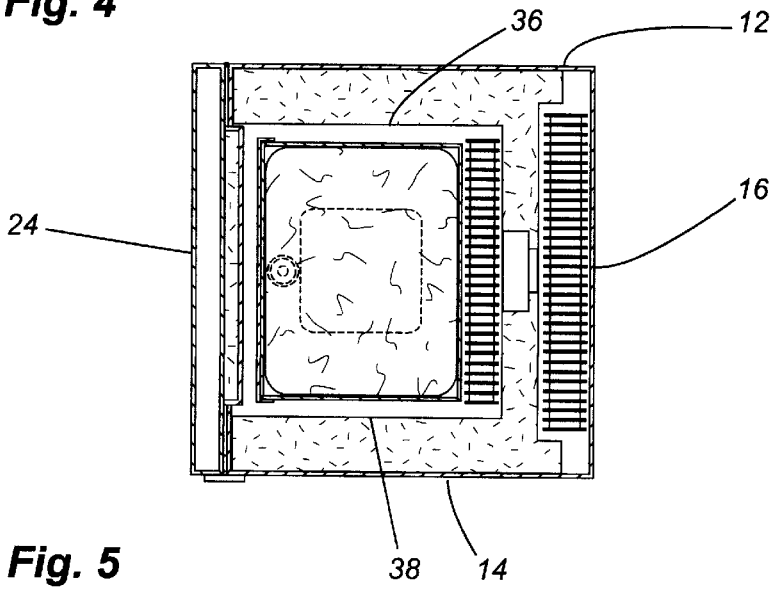
FIG. 5 is a sectional view taken along the lines 5—5 of FIG. 4.

Referring to the drawings in greater detail and by reference characters thereto, there is illustrated a juice dispensing apparatus according to one embodiment of the H present invention and which juice dispensing apparatus is generally designated by reference numeral 10.

Juice dispensing apparatus 10 has an outer housing which includes a pair of side walls 12, 14 and a rear wall 16. A gable top generally designated by reference 18 has a decorative cap 20 formed thereon such that dispensing apparatus 10 is of an overall configuration which somewhat resembles that of a conventional juice container such as is available for consumer purchase in retail outlets.

The housing also includes a lower front face which is generally designated by reference numeral 22 and an upper front portion which comprises a door 24 hingedly connected by means of hinge 26. A two piece locking handle 28 is provided to secure door 24 to side 14.

As may be seen in FIG. 1, lower front face 22 includes a centrally located recess 30 into which is placed a removable drip tray 32.

There is provided a juice container receiving compartment 51 interiorly of dispensing apparatus 10 and which is defined by an inner back wall 34, inner side wall 36, inner side wall 38, inner bottom wall 40, and inner top wall 42. Access to the compartment is provided by means on inner tiltable front wall or panel 44 which is connected by a hinge 46 to a support member 48.

As may be seen in FIG. 6, inner tiltable front wall 44 has flanges 50 formed along three sides of its periphery for reasons which will become apparent hereinbelow.

Also provided on inner tiltable front wall 44 are container abutment means comprising support members 52 which extend outwardly from the inner wall surface as well as a spigot support 54.

On the bottom of inner bottom wall 40, there is provided a scale generally designated by reference numeral 56. On top of scale 56, there is provided the vibrating means 60. Vibrating means 60 comprises a plurality of piezo ceramics 58 bonded to a glass substrate.

Provided between inner back wall 34 and exterior rear wall 60 is an interior dividing wall 70. Insulation 68 extends between dividing wall 70 and inner back wall 34 as well as at the bottom and sides of the compartment.

Mounted between inner back wall 34 and dividing wall 70 is a thermoelectric device generally designated by reference numeral 62. Associated with thermoelectric device is a cold heat sink 64 which is mounted interiorly of the juice container receiving compartment 51 while a hot heat sink 66 is mounted in a channel between exterior rear wall 16 and dividing wall 70.

A pair of lower fans 72 are mounted in the lower portion of dividing wall 70 while a pair of upper fans 74 are mounted in an upper portion of dividing wall 70.

Lower fans 72 are operative to take air from under the bottom portion of dispensing apparatus 10 and pass it upwardly past hot heat sink 66 as indicated by arrows 76. The hot air will then exit from vent apertures 78 formed in gable top 18.

Fans 74 are operative to move cool air past cold heat sink 64 as indicated by arrows 80. As will be noted, the cold air circulates constantly within the juice container receiving compartment 51.

At the bottom of dispensing apparatus 10, there is provided a circuit board 82 which is designed to operate and control the various operations of the dispensing apparatus 10 as will be discussed hereinbelow. On the front of lower front face 22 there is provided a control button 84 and a status indicator 86.

The dispensing apparatus 10 is designed to operate with a juice container generally designated by reference numeral 90 and which juice container 90 is preferably of the "bag and box" type. In this respect, there is provided a box 92 having a flexible bag 94 which contains juice. A spigot 96 has connected thereto a discharge tube 98.

Figure 6:
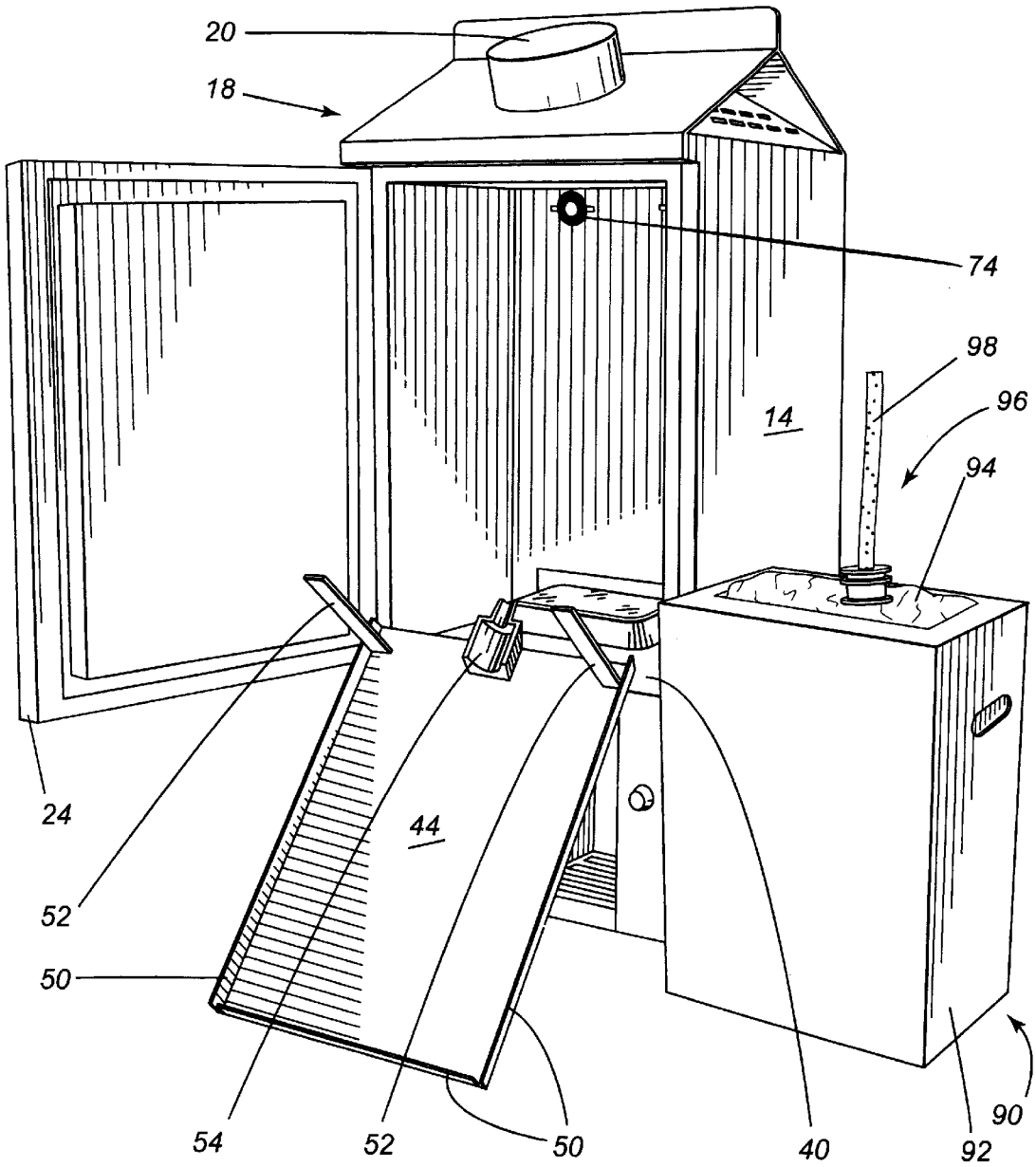
FIG. 6 is a front elevational view showing the internal compartment being open to receive a container of juice.
Figure 7:
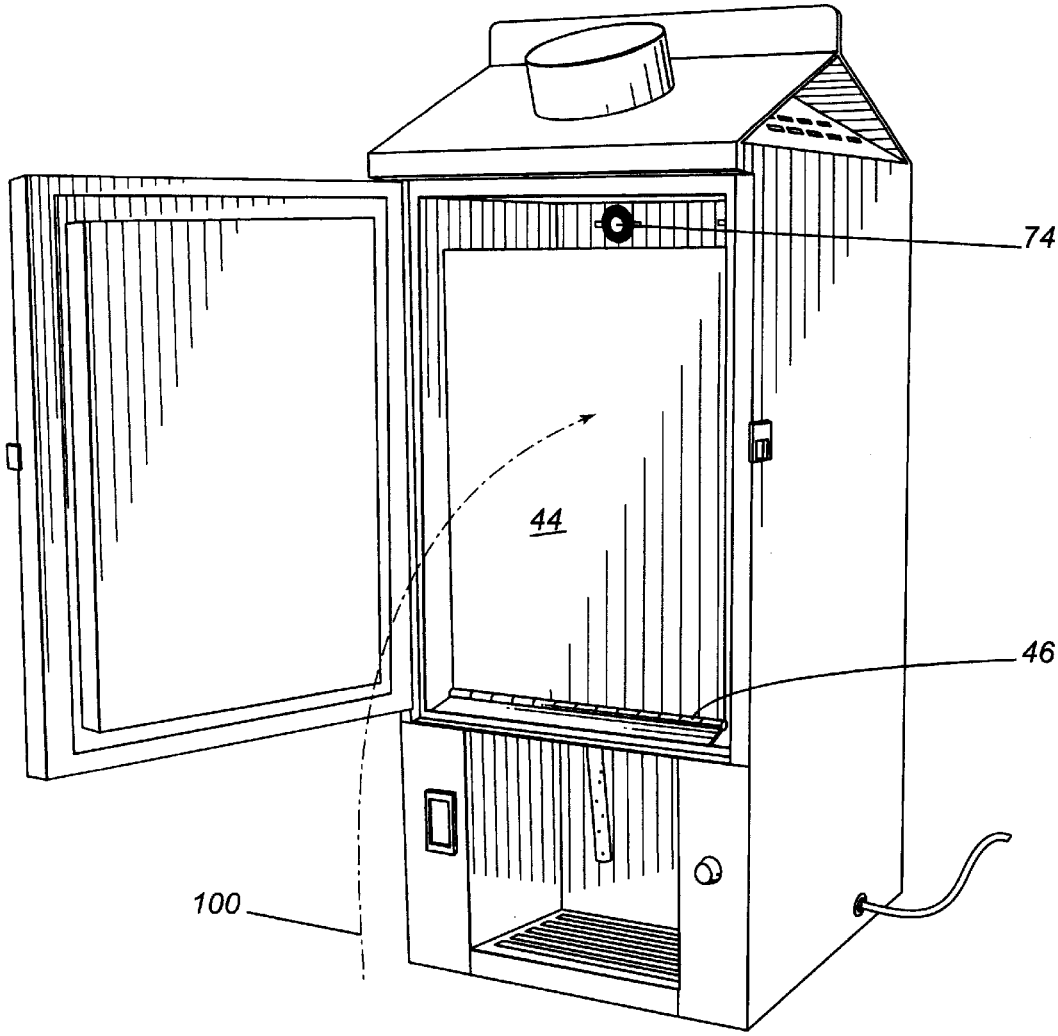
FIG. 7 is a view similar to FIG. 6 illustrating the closing of the apparatus after the container of juice has been placed in position.
Figure 8:
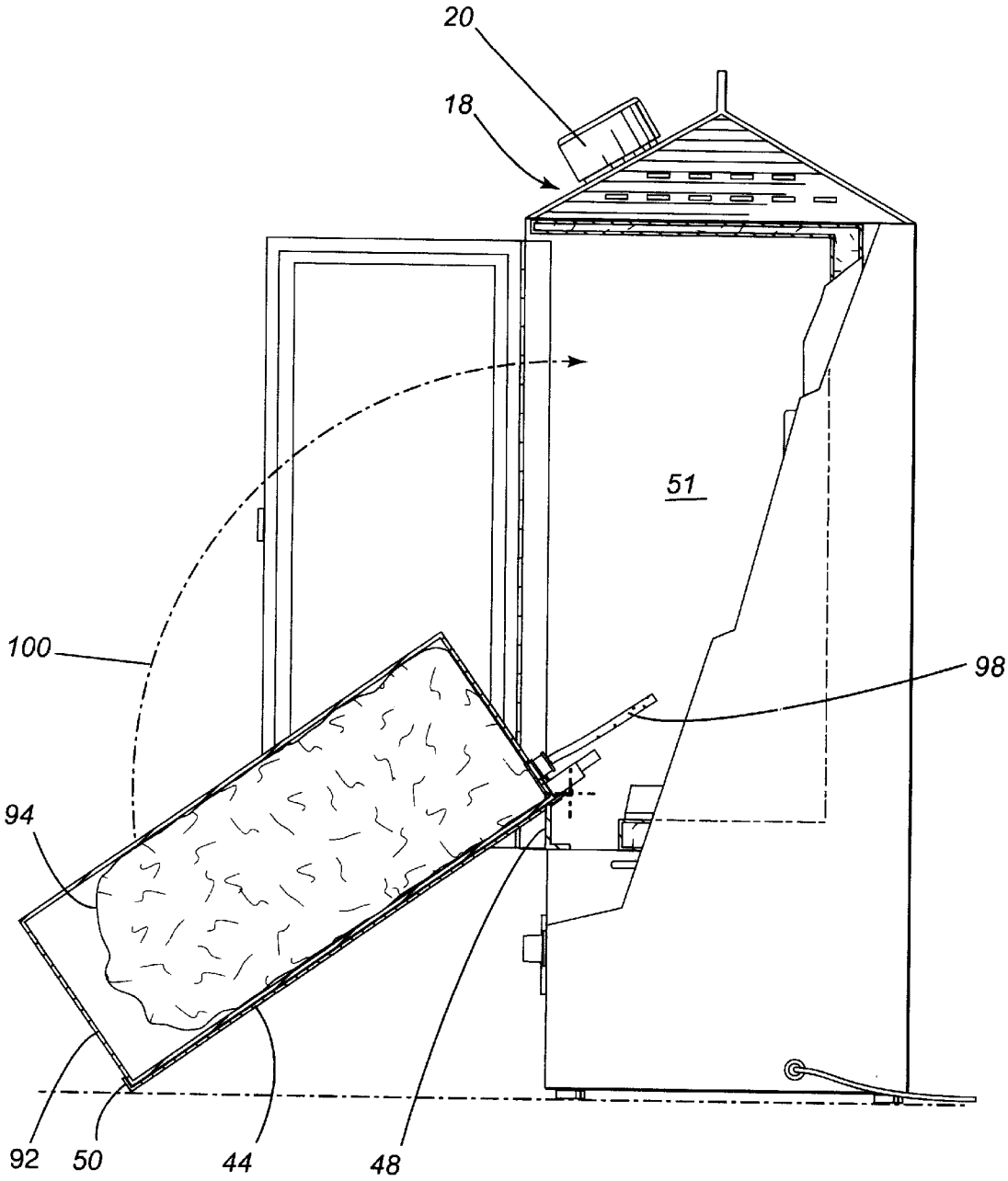
FIG. 8 is a side view, partially in section, illustrating the loading of a container of juice in the apparatus.

In operation, and as may be best seen in FIGS. 6, 7 and 8, a juice container 90 is placed next to the dispensing apparatus 10 wherein inner tiltable front wall 44 is moved to an open position as seen in FIG. 6. Container 90 need then only be moved into position as shown in FIG. 8 wherein box 92 is retained on the interior surface of inner tiltable panel 44 by means of flanges 50. Spigot support 54 is operative to support spigot 96.

Inner tiltable front wall 44 is then moved upwardly as indicated by arrow 100 to an upright position. As inner tiltable front wall 44 is moved to a closed position, container support members 52 are operative to support the bottom of box 92. It will be noted that box 92 has a cutout in its bottom wall as may be seen in FIG. 6 such that bag 94 is readily accessible. When placed in the juice container receiving compartment, bag 94 rests on agitating means 62 having piezo ceramics 58.

Figure 9:
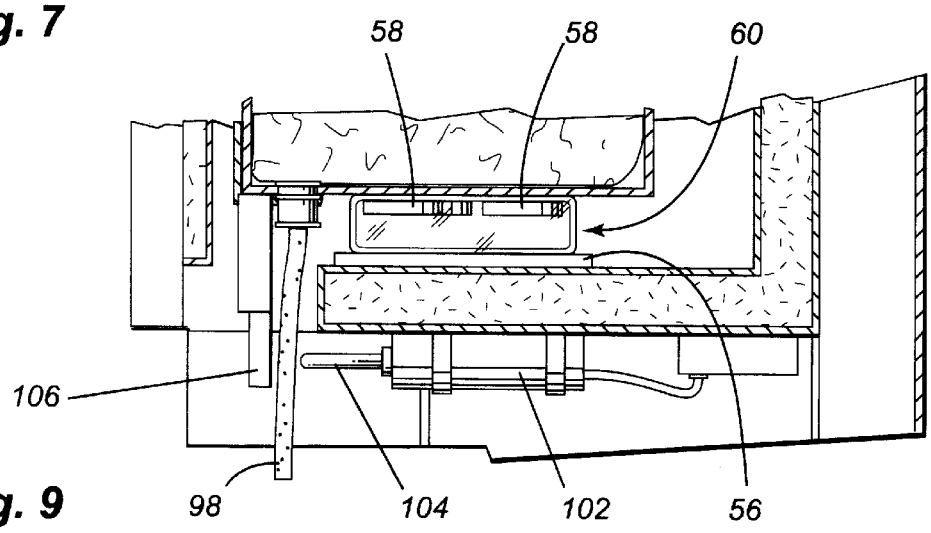
FIG. 9 is a cross sectional view of the bottom portion of the compartment containing the juice container.

Tube 98 is threaded through an aperture in inner bottom wall 40. As may be seen in FIG. 9, there is provided an actuator 102 which has moveable member 104 operative to pinch tube 98 between stop surface 106 and member 104 to permit or prevent flow of juice from tube 98. A suitable cap or stopper may be provided for tube 98.

As will be noted, a relatively small thermoelectric device 62 may be employed since the juice is shipped in a chilled state and placed in the well insulated compartment. Accordingly, one only needs to maintain the juice at the constant temperature.

The operation of the piezo ceramics 58 may be done on an intermittent basis. Thus, for example, one could have various duty cycles depending upon the juice, the amount of juice in the container, etc. It is to this end that scale 56 may be integrated with a control program such that the piezo ceramics 58 are activated for a shorter period of time as the amount of juice in container 90 diminishes.

Figure 10:
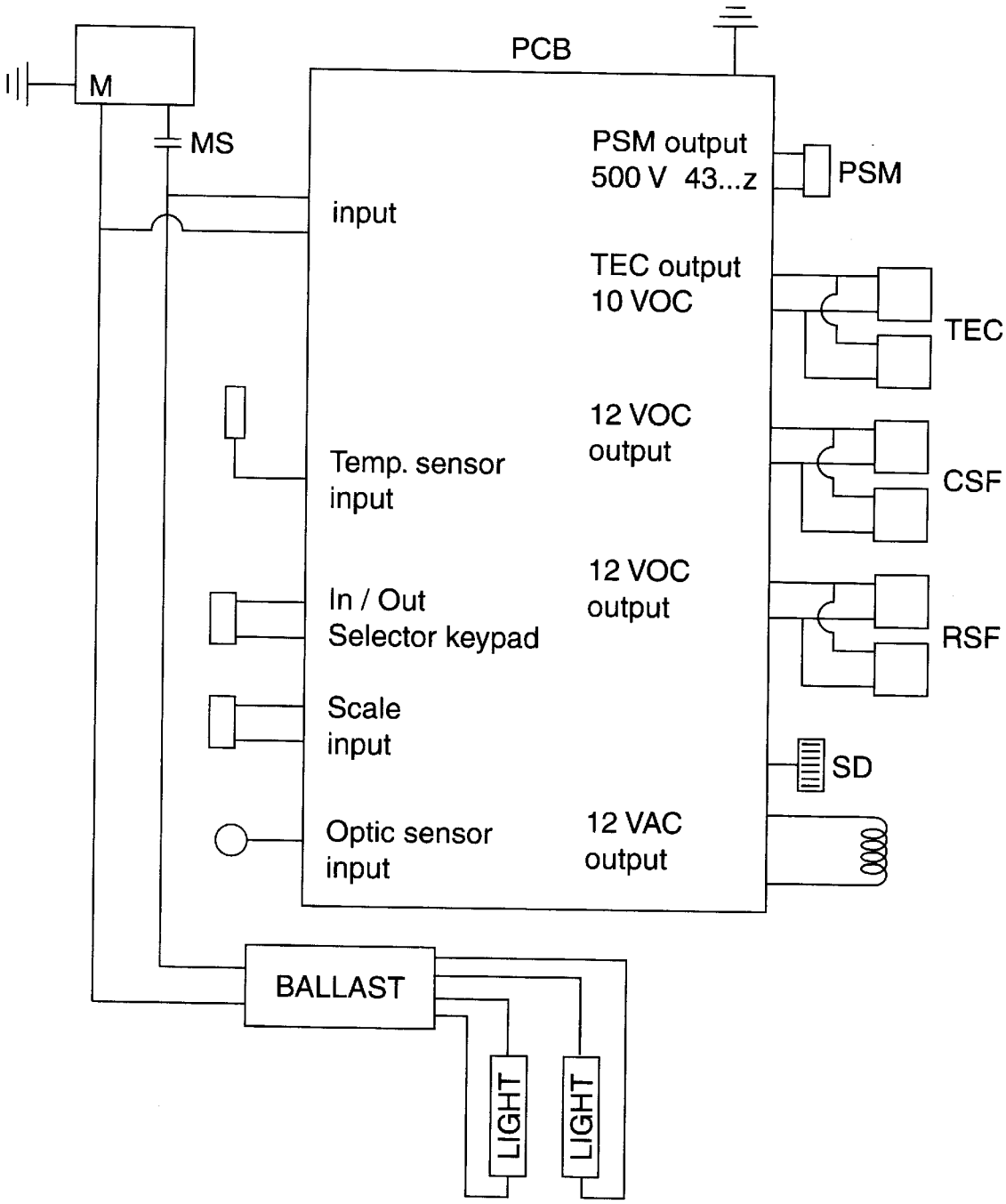
FIG. 10 is a schematic of the electrical portion of the apparatus.

The door 24 may have a translucent front panel with suitable graphics thereon. Lights 108 may be mounted rearwardly of the front panel as is known in the art. As shown in FIG. 10, the control of the apparatus may utilize a printed circuit board with a suitable power input. The power input may also be utilized to supply power to the lights mounted within door 24. Also, as shown, there may be provided inputs from a temperature sensor for the compartment 51. There may also be provided an optic sensor which would be used to detect the presence of a cup or other receptacle within the recess 30 such that the machine would not dispense without their being a suitable receptacle therein.

Figure 11:
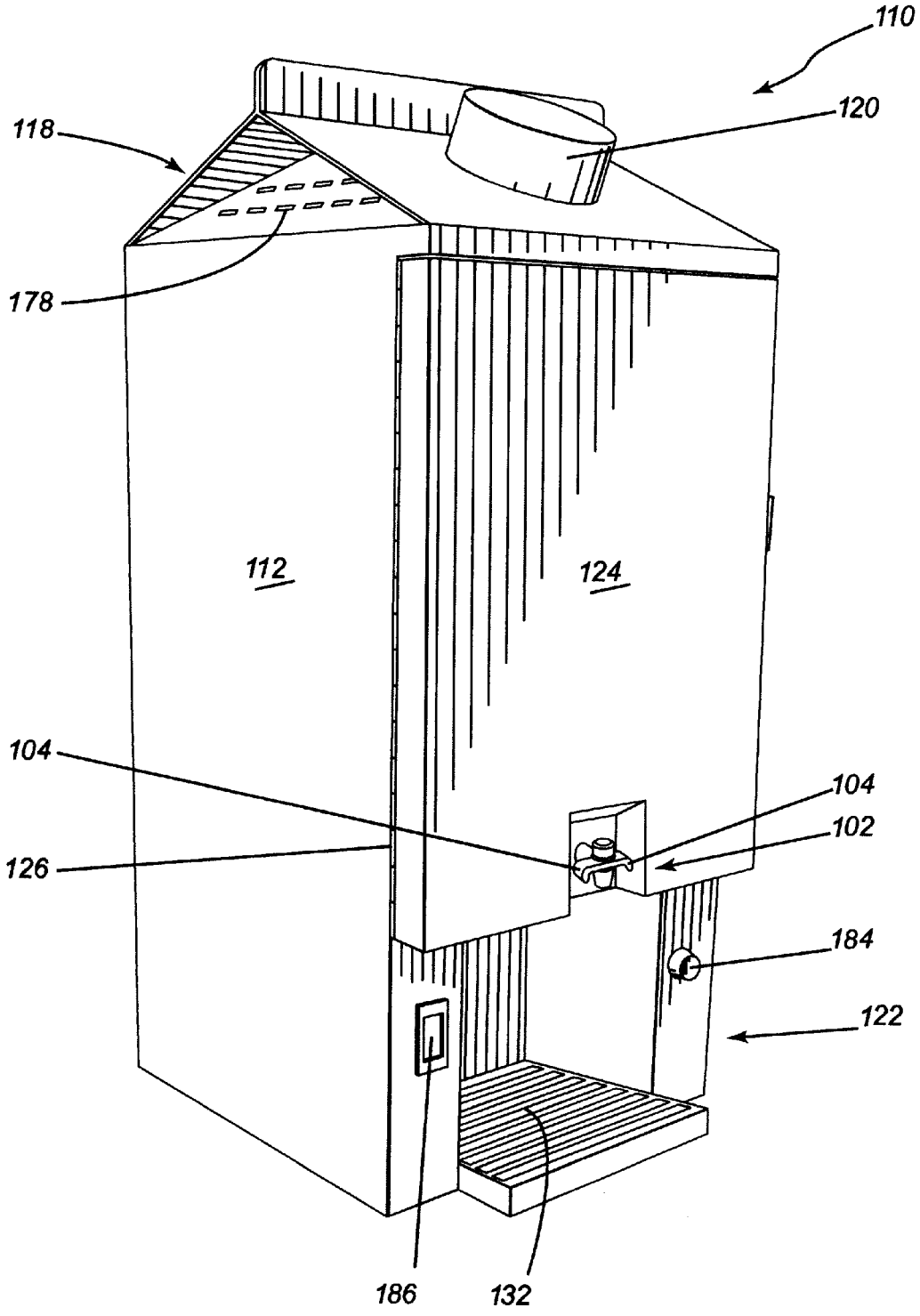
FIG. 11 is a perspective view of a further embodiment of a juice dispensing apparatus according to an embodiment of the present invention.

Referring to FIG. 11, there is illustrated a machine similar to that of the previously described embodiment. However, in this arrangement, there is provided a spigot which is in the form of a valve generally designated by reference numeral 102. Valve 102 is of the type formed in bags for dispensing fluids such as wine. Thus, valve 102 has a pair of ears 104 which may be lifted upwardly to permit the dispensing of the juice.

Many optional components can be integrated in the apparatus of the present invention. Thus, one could incorporate an automatic defrost by reversing the polarity of the chip at desired intervals. As previously mentioned, one can also utilize the scale to graduate the time for filling. From trials, one could determine the time to fill a given size of a glass or the like for a given weight of the container.

Other features could incorporate a high temperature sensor, a bar code sensor to ensure that the proper container is utilized and the like. One could also incorporate a modem which could transmit information concerning operation of the apparatus, including the amount of juice dispensed, to a central location.

It will be understood that the above described embodiments are for purposes of illustration only and that changes and modifications may be made thereto without departing from the spirit and scope of the invention.

I claim:

1. A fluid dispensing apparatus suitable for dispensing a fluid packaged in a container, said apparatus comprising:

a housing having a compartment to receive said container, said compartment including a tiltable panel forming one of the walls defining said compartment, said tiltable panel being hinged at a lower edge thereof, and said tiltable panel having container abutment means located proximate said lower edge for retaining and supporting said container thereon when said container is placed on said tiltable panel and said tiltable panel is moved to a closed position;

means for cooling said compartment;

means for agitating said fluid while in said container in said compartment; and means for controlling the flow of said fluid from said container.

2. The fluid dispensing apparatus of claim 1 wherein said means for cooling said compartment comprises thermoelectric means.

3. The fluid dispensing apparatus of claim 2 wherein said thermoelectric means includes a heat sink mounted in said compartment, said heat sink being connected to a cold side of said thermoelectric device.

4. The fluid dispensing apparatus of claim 1 wherein said means for agitating said fluid while in said container comprises piezoelectric means mounted below said container, said container being in contact with said piezoelectric means.

5. The fluid dispensing apparatus of claim 1 wherein said container abutment means comprises a pair of support members extending outwardly from an iner surface of said tiltable panel.

6. The fluid dispensing apparatus of claim 1 further including a scale mounted within said compartment such that when a container is placed therein, said scale is operative to measure the weight of said container.

7. The fluid dispensing apparatus of claim 6 wherein said agitating means are mounted on said scale.

8. In comination, a juice dispensing and a juice container, said juice container comprising a bag in a box containing a juice in said bag, said apparatus comprising:

a housing a compartment having a tiltable panel forming at least a portion of a wall defining said compartment, said tiltable panel being hinged at a lower edge thereof, said tiltable panel having container abutment means located proximate said lower edge for retaining said bag in a box thereon when said container as placed on said tiltable panel and moved from an open position to a closed position;

means for cooling said compartment;

means for agitating said juice in said juice container; and means for controlling the flow of said juice from said bag.

9. The combination of claim 8 wherein said means for agitating said juice comprises piezoelectric means mounted in a bottom portion of said compartment, said bag contacting said piezoelectric means.

10. The combination of claim 8 wherein said means for cooling said compartment comprise thermoelectric means.

11. The combination of claim 10 wherein said thermoelectric means includes a heat sink mounted in said compartment, said heat sink being connected to a cold side of said thermoelectric means.

12. The combination of claim 8 further including a scale mounted in said compartment, said container being on top of said scale.

13. A method for dispensing a juice packaged in a bag in a box comprising the steps of:

placing said bag in a box in a compartment of a juice dispensing apparatus;

cooling said compartment;

maintaining said bag in contact with agitating means;

agitating said bag to maintain said juice in a mixed condition;

weighing said bag; and discharging said juice from a dispensing outlet formed in said bag for a predetermined period of time according to the weight of the bag.

14. A fluid dispensing apparatus suitable for dispensing a fluid packaged in a container, said apparatus comprising a housing having a compartment to receive said container;

means for cooling said compartment;

a scale mounted within said compartment such that when a container is placed therein, said scale is operative to measure the weight of said container;

piezoelectric means mounted on an upper surface of said scale for agitating said fluid; and means for controlling the flow of said fluid from said container.

15. The fluid dispensing apparatus of claim 14 further including control means connected to said scale, said control means being operatively connected to said means for controlling the flow of said fluid to variably control the amount of time said fluid flows from said container in response to a signal from said scale.

* * * * *